US006679303B2

(12) United States Patent
Christ

(10) Patent No.: US 6,679,303 B2
(45) Date of Patent: Jan. 20, 2004

(54) TUBE-FILLING MACHINE

(75) Inventor: Richard Christ, Emmelshausen (DE)

(73) Assignee: IWK Verpackungatechnik GmbH, Stutensee (DE)

( * ) Notice: Subject to any disclaimer, the term of this patent is extended or adjusted under 35 U.S.C. 154(b) by 0 days.

(21) Appl. No.: 10/221,996

(22) PCT Filed: May 16, 2001

(86) PCT No.: PCT/EP01/05556

§ 371 (c)(1),
(2), (4) Date: Sep. 19, 2002

(87) PCT Pub. No.: WO01/89932

PCT Pub. Date: Nov. 29, 2001

(65) Prior Publication Data

US 2003/0041918 A1 Mar. 6, 2003

(30) Foreign Application Priority Data

May 23, 2000 (DE) ..... 100 25 063

(51) Int. Cl.[7] ..... B65B 1/30; B65B 3/28; B65B 57/06; B65B 57/14; B67C 3/00

(52) U.S. Cl. ..... 141/192; 141/94; 141/250; 141/263; 141/270; 141/284; 141/369; 141/374

(58) Field of Search ..... 141/94, 192, 198, 141/250, 256, 258, 263, 270, 284, 369, 374; 222/333

(56) References Cited

U.S. PATENT DOCUMENTS

| | | | | |
|---|---|---|---|---|
| 5,209,044 A | | 5/1993 | D'Addario | |
| 5,775,386 A | * | 7/1998 | Connan | 141/103 |
| 5,865,226 A | * | 2/1999 | Sweeney | 141/258 |

FOREIGN PATENT DOCUMENTS

| | | |
|---|---|---|
| CH | 669 765 | 4/1989 |
| DE | 1 099 926 | 2/1961 |
| DE | 38 42 929 | 9/1989 |
| WO | WO 97/299 54 | 8/1997 |

* cited by examiner

*Primary Examiner*—Timothy L. Maust
(74) *Attorney, Agent, or Firm*—Paul Vincent

(57) ABSTRACT

A tube-filling machine has a supply device for transporting a tube through different processing stations. The processing stations include a filling station in which a filling pipe is introduced from above into the substantially vertical tube. A filling medium is introduced through the filling pipe into the tube using a dosing device. To introduce the filling medium into the tube with high reliability and to prevent soiling of the tube-filling machine due to defective filling, a sensor device for detecting the relative position between the tube and the inserted filling pipe is disposed in the filling station and a control device is provided which receives a position signal from the sensor device in dependence on which the dosing means can be controlled by the control device.

6 Claims, 1 Drawing Sheet

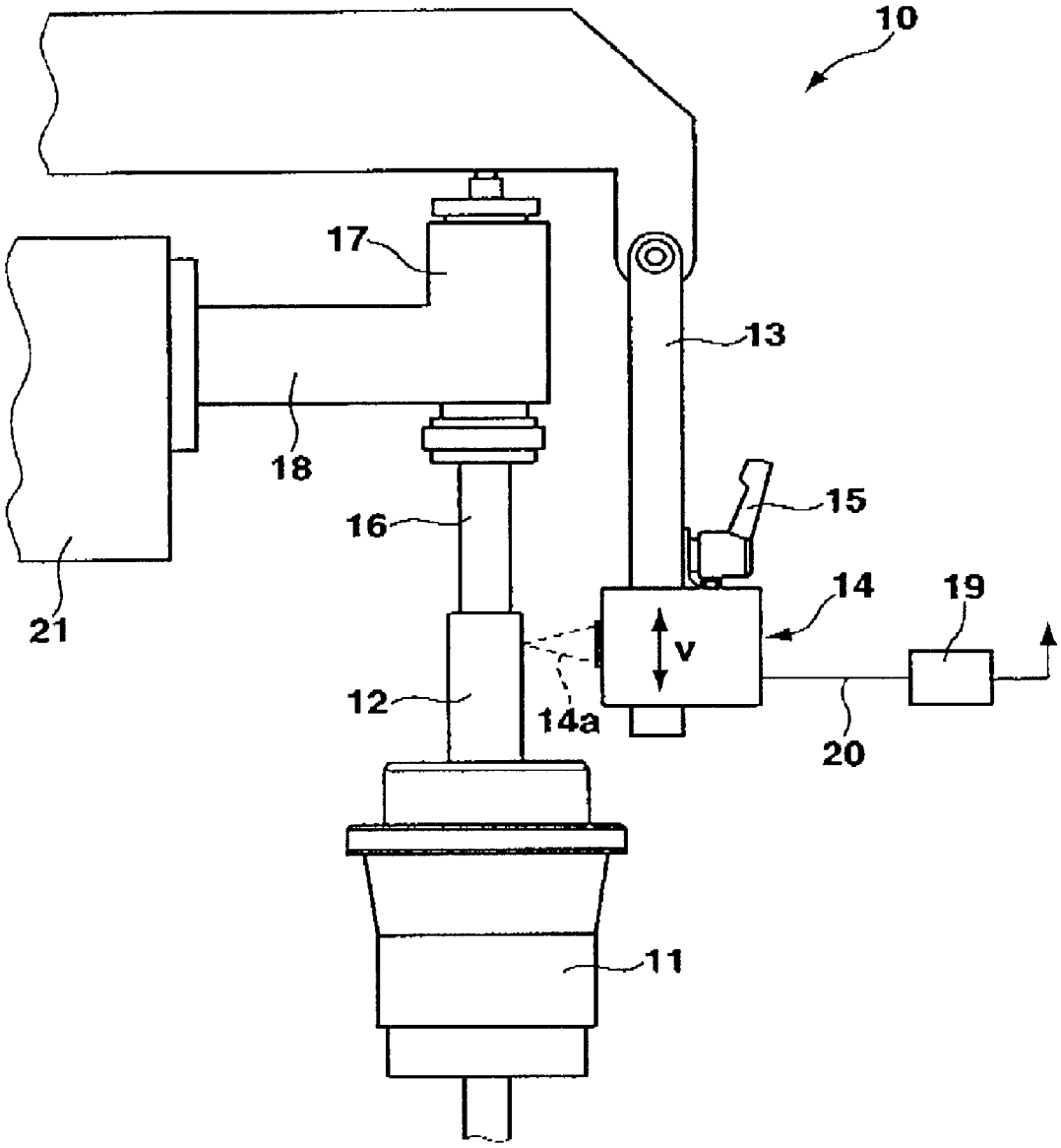
10
17
13
18
15
16
14
19
21
v
12
14a
20
11

TUBE-FILLING MACHINE

BACKGROUND OF THE INVENTION

The invention concerns a tube-filling machine comprising a conveyer device for transporting a tube through different processing stations, wherein the processing stations comprise a filling station in which a filling pipe can be inserted from above into the substantially vertical tube and through which a filling medium can be introduced into the tube via a dosing means.

A known tube-filling machine comprises a conveyer device which is usually an endless loop or chain and which has a plurality of receptacles for one tube each. The empty tubes are inserted into the receptacles of the conveyer device in a feed station and are transported through several workstations, in particular a filling station and a subsequent sealing station. In the filling station, the tubes are filled via a filling pipe which is connected to a filling medium storage via a dosing means. The filling process should only be carried out when a tube has actually been received in the respective receptacle. Towards this end, a sensory presence check is carried out directly after the feed station to determine whether or not a tube is actually located in the examined receptacle. If this is not the case, the filling process for this receptacle is stopped.

Moreover, immediately after the feed station, the orientation or rotational position of the tube is compared with a predetermined desired position and is optionally corrected. The tube must be disposed in the correct rotational position to seal the tube with the correct orientation.

Empty plastic tubes are usually eccentric, i.e. their cross-sectional shape differs more or less from an ideal circular cross-section. Conventionally, before the filling station, the tubes are checked for eccentricity and tubes which differ greatly from the desired shape are discarded. The eccentricity check is very demanding and also unreliable.

Only when all mentioned checks, i.e. presence check, orientation check and eccentricity check have been satisfactorily carried out, is the tube released for filling in the filling station. In this fashion, missing tubes and strongly deformed tubes can be reliably detected. However, slightly damaged or deformed tubes which are not discarded in the above mentioned checks often cause problems in the filling station.

In the filling station, a relative motion obtains between the vertical tube, with open upper end, and a downwardly projecting vertical filling pipe to introduce the filling pipe into the tube. The filling pipe is usually fixed in place and the tube is lifted. When the tubes have been previously damaged, the lower end of the filling pipe might not be inserted into the tube but can be lowered onto the tube wall thereby compressing or even crushing the tube during further relative motion. If the dosing means is then activated, the filling medium is not filled into the tube but is discharged into the tube-filling machine, thereby requiring cleaning at great expense.

The same problems occur when an empty tube is removed from a receptacle after the presence check or drops down to thereby cause discharge of the filing medium into the filling station, despite the missing tube.

With tubes which are intrinsically bent or which have been previously seriously damaged, the filling pipe might not be inserted into the tube, rather may come to rest beside the tube such that, in the subsequent "filling process", the filling medium is also spilled into the tube-filling machine.

It is therefore the underlying purpose of the present invention to produce a tube-filling machine of the mentioned type with which the filling medium is introduced into the tubes with high reliability such that soiling of the tube-filling machine through defective filling is avoided.

SUMMARY OF THE INVENTION

This object is achieved in accordance with a tube filling machine of the above mentioned type in that a sensor device for detecting the relative position between the tube and the inserted filling pipe is disposed in the filling station, a control device is provided which receives a position signal from the sensor device and the dosing means can be controlled by means of the control device in dependence on the position signal.

In accordance with the invention, correct insertion of the filling pipe into the tube is checked directly in the filling station immediately before the start of the filling process. Only when correct insertion has been detected, is the filling process enabled and triggered by the control device. In this fashion, one can ensure that, in case of defective, crushed or missing tubes, no filling medium is discharged via the dosing means to reliably prevent any associated soiling of the tube-filling machine. This also advantageously avoids the stoppage of the tube-filling machine which would be required for cleaning.

In a preferred embodiment of the invention, the filling pipe and the sensor device are fixed to a frame and the relative motion is produced by lifting the tube in the filling station until the filling pipe is inserted into the tube. The sensor device can be adjusted in a direction parallel to the direction of the relative motion between the tube and the filling pipe for accommodating it to different tube shapes. In particular, the sensor device can be detachably disposed on a vertical rail for displacement along that rail.

Should the sensor device determine that either there is no tube or that the filling pipe is not correctly inserted into the tube, the dosing means is not triggered by the control device. Since operation of the tube filling machine produces a rapid sequence of switching on and off of the dosing means, a further development of the invention provides that the dosing means and in particular the dosing piston is driven by a servomotor which is switched on or off by the control device in dependence on the position signal. The use of a servomotor is advantageous since, in this event, all drive elements of the dosing drive and with the dosing piston are only in motion during the actual dosing process. All drive elements for the dosing piston are at rest immediately prior to the beginning of the dosing process. The above-mentioned sensor request is preferably effected immediately before the planned start of the dosing process. Prompt interruption is easily possible in this phase. Even if the sensor request should be carried out simultaneously with or directly after the start of the dosing process, the filling or dosing process can be aborted in the early phase due to the small inertia of the dosing drive of the filling or dosing process. This reliably prevents trailing of the dosing means and therefore discharge of the filling medium at an undesired point in time.

The sensor device must determine whether a tube is present and must check whether the filling pipe is correctly immersed into the tube. In an embodiment of the invention, the sensor device comprises an optical sensor and a light source which directs a beam of light onto the outer surface of the filling pipe. The light source and the sensor can thereby be disposed in a common housing. When the tube is lifted during insertion of the filling pipe, it enters the path of rays of this beam such that it no longer directly impinges on the outer surface of the filling pipe. This change in optical condition is detected and correspondingly evaluated by the control device. The optical sensor thereby detects, in particular, the reflected beam of light.

One single light source is normally sufficient for directing a single beam onto the filling pipe. However, in a further development of the invention, several beams are directed onto the filling pipe from different directions and are evaluated to ensure that the tube completely surrounds the filling pipe.

Further details and features of the invention can be extracted from the following description of an embodiment with reference to the drawing.

BRIEF DESCRIPTION OF THE DRAWING

The single FIGURE shows a filling station of a tube-filling machine.

DESCRIPTION OF THE PREFERRED EMBODIMENT

The FIGURE shows a filling station 10 of a tube-filling machine which is connected via a feed line 18 to a supply container (not shown) for a filling medium. An inhibiting means 17 is integrated in the feed line 18, is disposed directly above a vertical, downwardly extending filling pipe 16, and is fixed, together therewith, to a rotary valve 21 of the filling station 10. A dosing piston is driven by a servomotor in a conventional fashion (not shown).

A vertical guiding rail 13 extends parallel to the longitudinal extension of the filling pipe 16 and supports a sensor device 14 which can be fixed by means of a holding device 15 e.g. in the form of a clamping unit. The double arrow V indicates that the sensor device 14 can be adjusted along the vertical guiding rail 13.

A supply device (not shown) comprises a plurality of tube holders 11 for insertion of one plastic tube 12 each such that they are oriented substantially vertically with the open end facing upwardly. The tube holder 11 can be lifted together with the tube 12 in the filling station 10 such that the filling pipe 16 is inserted into the tube 12.

The sensor device 14 emits a beam 14*a* which is directed onto the surface of the filling pipe 16. The beam portion reflected from the metal filling pipe 16 is detected via an optical sensor integrated in the sensor device 14, and a corresponding position or presence signal is sent to a control device 19 via a data line 20. As long as the beam 14*a* is reflected on the surface of the filling pipe 16, the sensor device 14 determines that no tube is present. When the tube holder 11 including tube 12 is lifted and the filling pipe 16 enters the tube 12, the tube enters the beam 14*a* to thereby change the properties of the reflected beam since the tube 12 has other reflection properties. These changes in the reflection behavior are detected by the optical sensor of the sensor device 14 and a corresponding presence signal is transmitted to the control device 19 via the data line 20 to indicate that a tube 12 is present and has the required insertion depth. The control device 19 then activates the servomotor of the dosing piston to fill the tube 12 with the filling medium through the filling pipe 16.

The FIGURE shows that the beam 14*a* of the sensor device 14 is oriented to impinge on the tube 12 close to the upper edge when the tube 12 has been completely lifted. In this manner, the tube 12 enters into the beam 14*a* only when it is sufficiently lifted or when the filling pipe 16 is sufficiently inserted into the tube 12.

To adjust the filling station to a different tube size or length or to a different insertion depth, only the holding device 15 of the sensor device 14 must be released and the sensor device 14 must be adjusted by the desired amount along the guiding rail 13.

What is claimed is:

1. A tube filling machine for filling a substantially vertical tube, the tube filling machine having a feed device for transporting the tube through different processing stations, the processing stations including a filling station, the filling station comprising:

a filling pipe for insertion into the tube from an upper direction, said filling pipe for introducing a filling medium into the tube;

a dosing means cooperating with said filling pipe for determining an amount of filling medium introduced into the tube;

a sensor device disposed in the filling station to detect a relative axial position between the tube and said filling pipe during introduction of said filling pipe into the tube;

a control device communicating with said sensor device to receive a position signal from said sensor device, said control device also communicating with said dosing means to control operation of said dosing means in dependence on said position signal; and means for adjusting said sensor device in a direction parallel to a direction of relative motion between the tube and said filling pipe.

2. The tube-filling machine of claim 1, wherein said dosing device is driven by a servomotor and said control device switches said servomotor on or off in dependence on said position signal.

3. The tube-filling machine of claim 1, wherein said filling pipe and said sensor device are fixed to a frame and said tube can be lifted in the filling station.

4. The tube-filling machine of claim 1, wherein said sensor device comprises an optical sensor and a light source which directs a beam of light onto an outer surface of said filling pipe, wherein the tube can be brought into a path of said beam when introducing said filling pipe.

5. The tube-filling machine of claim 4, wherein a reflected said light beam can be detected by means of said optical sensor.

6. The tube-filling machine of claim 1, wherein said adjusting means comprise a vertical guiding rail extending parallel to a longitudinal extension of said filling pipe to support said sensor device and a holding device cooperating with said sensor device and said guiding rail to fix said sensor device along said guiding rail.

* * * * *